US009289812B2

(12) United States Patent
König et al.

(10) Patent No.: US 9,289,812 B2
(45) Date of Patent: Mar. 22, 2016

(54) DEVICE AND METHOD FOR MACHINING A WORKPIECE CONSISTING OF METAL, PARTICULARLY FOR PRODUCING A CUP-SHAPED COMPONENT FOR THE AUTOMOBILE INDUSTRY, AS WELL AS SUCH A WORKPIECE

(71) Applicant: Allgaier Werke GmbH, Uhingen (DE)

(72) Inventors: Peter König, Göppingen (DE); Michael Wolf, Uhingen (DE); Ottmar Lehr, Rechberghausen (DE); Klaus Leinmüller, Iggingen-Brainkofen (DE); Dieter Waidmann, Heuchlingen (DE)

(73) Assignee: Allgaier Werke GmbH, Uhingen (DE)

( * ) Notice: Subject to any disclaimer, the term of this patent is extended or adjusted under 35 U.S.C. 154(b) by 0 days.

(21) Appl. No.: 14/463,490

(22) Filed: Aug. 19, 2014

(65) Prior Publication Data

US 2014/0352390 A1 Dec. 4, 2014

Related U.S. Application Data

(63) Continuation of application No. PCT/EP2013/055553, filed on Mar. 18, 2013.

(30) Foreign Application Priority Data

Mar. 22, 2012 (DE) ..... 10 2012 005 635

(51) Int. Cl.
*B21D 22/20* (2006.01)
*B21D 22/22* (2006.01)
(Continued)

(52) U.S. Cl.
CPC ..... *B21D 22/20* (2013.01); *B21D 22/22* (2013.01); *B21D 24/04* (2013.01); *B21D 24/10* (2013.01); *B21D 51/22* (2013.01)

(58) Field of Classification Search
CPC ..... B21D 22/22; B21D 22/28; B21D 22/30; B21D 22/20; B21D 24/04; B21D 24/10; B21D 51/22
USPC ..... 72/347–350
See application file for complete search history.

(56) References Cited

U.S. PATENT DOCUMENTS 4,193,285 A 3/1980 Zumsteg
4,584,859 A * 4/1986 Saunders ..... 72/349
(Continued)

FOREIGN PATENT DOCUMENTS

CN 1136480 A 11/1996
CN 1434282 A 8/2003
(Continued)

OTHER PUBLICATIONS

International Preliminary Report on Patentability dated Jan. 23, 2014 for International Application No. PCT/EP2013/055553 (13 pages).
(Continued)

*Primary Examiner* — Teresa M Ekiert
(74) *Attorney, Agent, or Firm* — Taylor IP, P.C.

(57) ABSTRACT

The invention relates to an apparatus, an installation and a method for machining a workpiece made of metal, such as steel, by a machining processes such as forming, pressing, drawing, compressing and cutting. The invention includes at least two tools and a drive associated with the tools for their movement and for carrying out the machining process. The drives are arranged in such a way that when travelling on trajectories the tools have different speeds over at least a part of their trajectories.

11 Claims, 2 Drawing Sheets

(51) Int. Cl.

| | |
|---|---|
| ***B21D 24/04*** | (2006.01) |
| ***B21D 24/10*** | (2006.01) |
| ***B21D 51/22*** | (2006.01) |

(56) References Cited

U.S. PATENT DOCUMENTS

| | | | | |
|---|---|---|---|---|
| 7,237,423 | B1 * | 7/2007 | Nagel et al. | 72/350 |
| 7,257,460 | B2 * | 8/2007 | Venugopal et al. | 72/351 |
| 2008/0098789 | A1 * | 5/2008 | Hori et al. | 72/349 |
| 2010/0064759 | A1 * | 3/2010 | Kondo et al. | 72/364 |
| 2010/0186475 | A1 * | 7/2010 | Hirotani | 72/349 |

FOREIGN PATENT DOCUMENTS

| | | | |
|---|---|---|---|
| DE | 27 27 174 | A1 | 12/1978 |
| DE | 197 24 766 | A1 | 12/1998 |
| DE | 102 54 103 | B3 | 4/2004 |
| DE | 10 2007 050 581 | A1 | 4/2009 |
| JP | 2011-056573 | A | 3/2011 |
| WO | 2012/123583 | A1 | 9/2012 |

OTHER PUBLICATIONS

Notification Concerning Transmittal of International Preliminary Report on Patentability and Written Decision of the International Searching Authority dated May 21, 2013 for International Application No. PCT/EP202013/055553 (11 pages).

Communication from Chinese Patent Office dated Jul. 31, 2015 for parallel Chinese Application No. 201380010761.9 (6 pages).

* cited by examiner

DEVICE AND METHOD FOR MACHINING A WORKPIECE CONSISTING OF METAL, PARTICULARLY FOR PRODUCING A CUP-SHAPED COMPONENT FOR THE AUTOMOBILE INDUSTRY, AS WELL AS SUCH A WORKPIECE

CROSS REFERENCE TO RELATED APPLICATIONS

This is a continuation of PCT application No. PCT/EP2013/055553, entitled "DEVICE AND METHOD FOR MACHINING A WORKPIECE CONSISTING OF METAL, PARTICULARLY FOR PRODUCING A CUP-SHAPED COMPONENT FOR THE AUTOMOBILE INDUSTRY, AS WELL AS SUCH A WORKPIECE" filed Mar. 18, 2013, which is incorporated herein by reference.

BACKGROUND OF THE INVENTION

1. Field of the Invention

The present invention relates to the field of machining workpieces made of metal, such as steel, and, more particularly, to an apparatus to form a workpiece.

2. Description of the Related Art

The machining of a workpiece can include any process such as cutting, pressing, drawing and shaping.

Pot-shaped components can include a bottom, a container wall and a drawn edge. Such a component is often used as a spring cup for accommodating the ends of a coil spring. They are used widely in the automotive industry in particular.

High-strength steels are problematic in the production of such spring cups. Although these have the advantage that they have extremely high tensile strengths, such steels are relatively brittle and prone to tearing. Therefore steels of lesser thickness and lower weight may be used. This occurs particularly during deformation at high stress transition zones. The tearing occurs in particular in the transition regions between the cup bottom and cup wall and between the cup wall and drawn edge.

DE 102 54 103 B3 describes a deep-drawing tool for deep drawing of formed parts. This includes an annular clamping device for clamping a blank. The clamping device encloses a space in which a bottom and a former body are movable in the drawing direction. These two may have different speeds, which should lead to higher forming precision.

DE 27 27 174 C2 describes a method and an apparatus for deep drawing of an aluminium container. In this case, two parts are mutually movable, namely a punch and a die. The speed of the upwardly moving punch can be greater than the speed of downwardly moving die. A high drawing ratio is achieved in this way.

DE 10 2007 050 581 A1 discloses a method for influencing the sheet thickness progression in deep drawing of hollow bodies. This involves multiple cambering (deformation) and back cambering (reforming) of a workpiece. During the reforming phase, the relative velocity between the punch and the die is increased relative to the increased rate during the deforming phase. The punch performs a movement against the deforming phase during the reforming phase. The speeds of the punch during the phases are unequal.

What is needed in the art is an apparatus and method so that high-strength steels can be formed without leading to any tearing in the edge regions and drawn to a greater depth than could be achieved before.

SUMMARY OF THE INVENTION

The present invention provides an apparatus, an installation and a method to machine high-strength metals into a workpiece by using a punch and a die in two parts, which together form a substantially cylindrical inner part and a ring surrounding it. All four components mentioned can be moved in the drawing direction for the purpose of forming.

At least two of the parts involved in the drawing process can have different speeds, at least during certain stages of forming. In particular, the inner die may have a higher speed than the outer die.

The following procedures are possible:

I. During the initial phase, both dies move in the same direction with the same speed.

II. During the middle phase, the two dies move in one and the same direction, but the inner die at a higher speed than the outer die.

III. In the final stage the inner die is stationary, while the outer die continues to move at constant speed.

Further variants are also possible. The outer die can move from the beginning at constant speed. In contrast, the trajectory of the inner die can equal to the inner curve of a controlled movement (e.g., a sine curve) starting from a lower speed than that of the outer die, then exceeding the initial speed and then decreasing again. The speed differences can be significant, for instance the speed of the inner die can be 1.5-2, 2.5 or 3 times greater than the speed of the outer die.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention and such exemplification is not to be construed as limiting the scope of the invention in any manner.

DETAILED DESCRIPTION OF THE INVENTION

Figure 1:
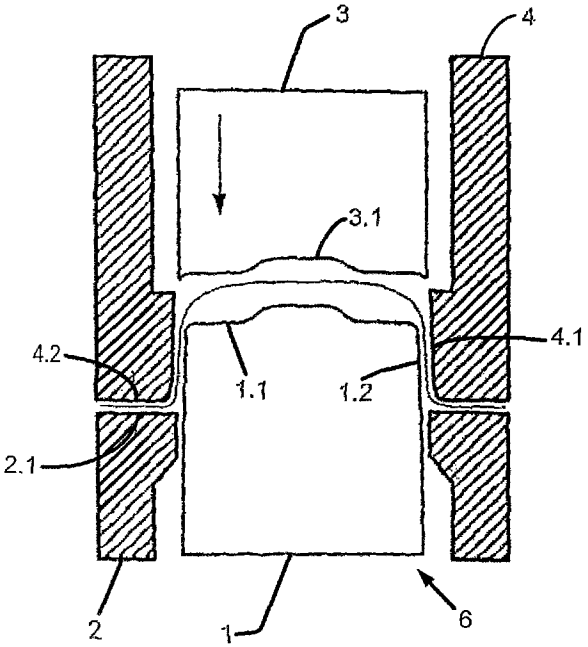
FIG. 1 is a schematic view of a drawing apparatus with an already pre-formed workpiece in a first forming phase, namely the entire forming stroke.
Figure 4:
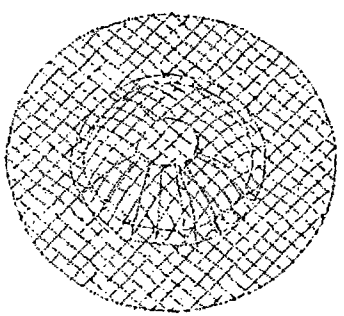
FIG. 4 is a perspective view of a workpiece at the end of the first forming station.
Figure 5:
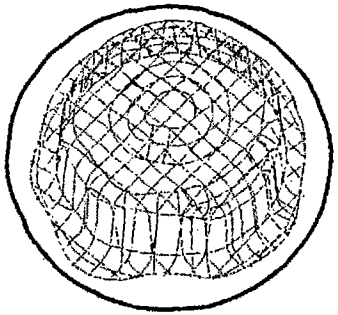
FIG. 5 is a perspective view of a workpiece at the end of the second forming station.
Figure 6:
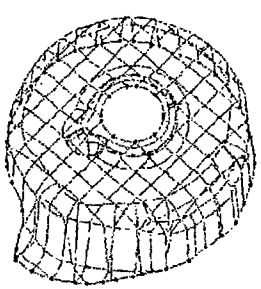
FIG. 6 is a perspective view of a workpiece at the end of the third forming station.
Figure 7:
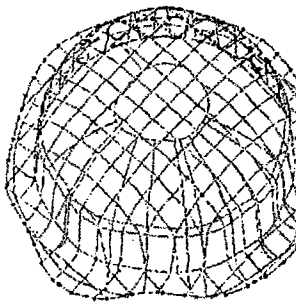
FIG. 7 is a perspective view of a workpiece at the end of the fourth forming station.
Figure 8:
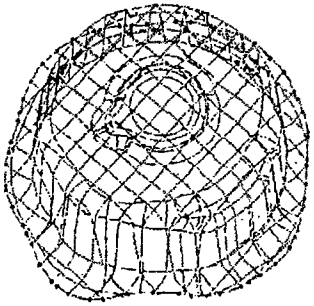
FIG. 8 is a perspective view of a workpiece at the end of the fifth forming station.
Figure 9:
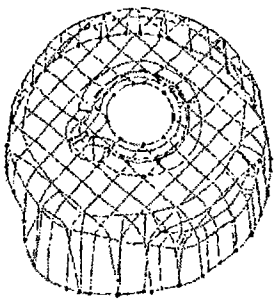
FIG. 9 is a perspective view of a workpiece at the end of the sixth forming station.

Referring now to the drawings, and more particularly to FIG. 1, there is shown a drawing apparatus 6, which generally includes a punch 1, a blank holder 2, and a workpiece 5. The punch 1 is one of a slightly conical shape. It includes a bottom forming area 1.1 and a wall forming area 1.2. A blank holder 2 surrounds the punch 1. The blank holder 2 has a supporting surface 2.1. The blank holder 2 is annular.

An inner die 3 is situated above the punch 1, and surrounded by an outer die 4. The inner die 3 is substantially cylindrical. The inner die 3 is annular. In turn, the inner die 3 has a bottom forming area 3.1. The outer die 4 is also annular. The outer die 4 includes a wall forming area 4.1, and further includes a clamping surface 4.2 for tightly clamping the drawn edge 5.3 of a workpiece 5 on the supporting surface 2.1 of the blank holder 2.

Figure 3:
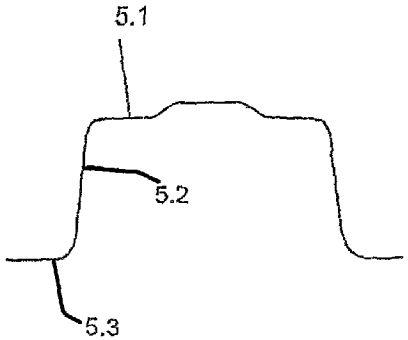
FIG. 3 is a front view of the workpiece at the end of the forming process.
Figure 2:
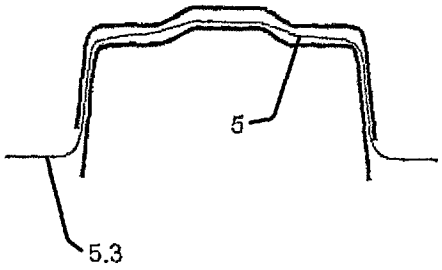
FIG. 2 is a front view of the workpiece just before the end of the second forming stage.

The workpiece 5 is the result of a circular disk-shaped plate or a sheet metal blank (FIG. 2). The workpiece 5 includes a base 5.1, a wall 5.2, and the drawn edge 5.3 (FIG. 2). The drawing apparatus 6 forms the sheet metal blank into the workpiece 5. The end result of the workpiece 5 is a pot. However, the workpiece 5 may be machined in any advantageous shape within the scope of the present invention. The workpiece 5 may be made of high-strength steel, an alloy, or any other suitable metal.

The drawing apparatus 6 operates as follows: the drawing apparatus 6 is initially open to receive the workpiece 5 (i.e., a sheet metal blank or pre-shaped workpiece), which means the clamping surface 4.2 of the outer die 4 is located approximately at the height of the bottom forming area 3.1 of the inner die 3. The supporting surface 2.1 of the blank holder 2 is located at approximately the same height. In this phase, a workpiece 5 is inserted into the drawing apparatus 6 and clamped between the supporting surface 2.1 and the clamping surface 4.2. Now, the actual working phase of the drawing apparatus 6 begins. The inner die 3 and the outer die 4 move together with the workpiece 5, as well as the blank holder 2, downwardly in the drawing direction, illustrated by the arrow (FIG. 1). The above-mentioned parts (inner die 3, outer die 4, blank holder 2 and pre-shaped workpiece) have the same speed. This will change according to the invention in a subsequent phase. The inner die 3 overtakes the outer die 4. In a further subsequent stage, however, the outer die 4 overtakes the inner die 3. Notice must be taken that this also can be reversed.

The drawing apparatus 6 is only one station of a series of drawing stations. In practice, they are connected in series in a workshop (not shown). In this case, only one drawing station needs to be designed according to the invention, i.e., it is provided with drives which can provide the inner die 3 on the one hand and the outer die 4 and the blank holder 2 on the other hand with different speeds during the drawing process.

A drive (not shown) is respectively associated with at least two parts including the punch 1, the blank holder 2, the inner die 3 and the outer die 4, all of which are involved in the drawing process. The drive moves these two parts simultaneously with different respective speeds during a specific phase of the forming process.

Referring now to FIGS. 4-9, there is shown the workpiece 5 after leaving the various drawing stations. The drawn edge 5.3 can also be punched off from the wall 5.2 after the last drawing process, depending on the use of the completed cup-shaped workpiece.

Further possibilities for realizing the invention are as follows:

The punch 1 can be also be moved up and down, and/or

In a kinematic reversal, the blank holder 2 and the outer die 4 with the clamped workpiece 5 on the one hand and the punch 1 on the other hand move upwardly. The middle die 3 is stationary.

During the drawing process, the middle die 3 stops and/or the blank holder 2 and the outer die 4 stop.

The present invention is described in terms of producing a pot-shaped component. It is understood, however, that hollow bodies deviating from the pot shape or cup shape can also be produced with the present invention. The dies can also have shapes that deviate from the described shapes including a disk and a ring.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for forming a sheet metal blank into a pot including a bottom, a wall and a drawn edge, said apparatus comprising:

a punch with a bottom forming area forming the bottom and a wall forming area forming the wall;

an annular blank holder surrounding said punch and having a supporting surface for placing the drawn edge;

an inner die with a bottom forming area;

an outer die with a wall forming area and a clamping area for gripping the drawn edge and for pressing the drawn edge against the supporting surface of said annular blank holder; and a drive respectively associated with at least two parts including the punch, the annular blank holder, the inner die and the outer die, all of which are involved in a drawing process, wherein said drive moves said at least two parts simultaneously with different respective speeds in the drawing direction during a specific phase of the forming.

2. An apparatus for forming a sheet metal blank into a pot including a bottom, a wall and a drawn edge, said apparatus comprising:

a punch with a bottom forming area forming the bottom and a wall forming area forming the wall;

an annular blank holder surrounding said punch and having a supporting surface for placing the drawn edge;

an inner die with a bottom forming area;

an outer die with a wall forming area and a clamping area for gripping the drawn edge and for pressing the drawn edge against the supporting surface of said annular blank holder; and a drive respectively associated with at least two parts including the punch, the annular blank holder, the inner die and the outer die, all of which are involved in a drawing process, wherein said drive moves said at least two parts simultaneously with different respective speeds in the drawing direction during a specific phase of the forming, wherein said drive is respectively associated with the inner die, and the outer die and the annular blank holder, in which the inner die overtakes the outer die in a first phase, and the outer die overtakes the inner die in a subsequent phase.

3. The apparatus according to claim 2, wherein said drive is respectively associated with the inner die, and the outer die and the annular blank holder, in which the outer die overtakes the inner die in a first phase, and the inner die overtakes the outer die in a subsequent phase.

4. The apparatus according to claim 2, wherein said annular blank holder, said outer die and said punch are movable by the drive in a drawing direction.

5. The apparatus according to claim 2, wherein said wall forming area of the punch extends conically towards the bottom forming area of the punch.

6. The apparatus according to claim 4, wherein said wall forming area of the outer die tapers in the drawing direction.

7. The apparatus according to claim 2, wherein said apparatus includes a plurality of drawing stations which together form an installation.

8. A method for forming a sheet metal blank into a pot with a bottom, a wall, and a drawn edge by using a drawing apparatus, including:

a punch with a bottom forming area forming the bottom and a wall forming area forming the wall;

an annular blank holder surrounding said punch and having a supporting surface for placing the drawn edge;

an inner die with a bottom forming area; and an outer die with a wall forming area and a clamping area for gripping the drawn edge and for pressing the drawn edge against the supporting surface of said annular blank holder, the method comprising the steps of:

placing a sheet metal blank or a pre-shaped workpiece produced therefrom inside said drawing apparatus;

moving the inner die, the outer die, and the annular blank holder in the drawing direction together with a clamped sheet metal blank or with a clamped pre-shaped workpiece during a first forming phase; and moving the inner die to overtake the outer die during a phase of a forming process.

9. A method for forming a sheet metal blank into a pot with a bottom, a wall, and a drawn edge by using a drawing apparatus, including:

a punch with a bottom forming area forming the bottom and a wall forming area forming the wall;

an annular blank holder surrounding said punch and having a supporting surface for placing the drawn edge;

an inner die with a bottom forming area; and an outer die with a wall forming area and a clamping area for gripping the drawn edge and for pressing the drawn edge against the supporting surface of said annular blank holder, the method comprising the steps of:

placing a sheet metal blank or a pre-shaped workpiece produced therefrom inside said drawing apparatus;

moving the inner die, the outer die, and the annular blank holder in the drawing direction together with a clamped sheet metal blank or with a clamped pre-shaped workpiece during a first forming phase; and moving the outer die to overtake the inner die, as the inner die maintains a non-zero velocity, during a phase of a forming process.

10. The method according to claim 8, including the further steps of:

moving said inner die and said outer die in the same direction at equal velocity during an initial phase;

moving said inner die and said outer die in the same direction during a middle phase, but the inner die travels at higher velocity than the outer die; and keeping the inner die stationary in an final phase, while the outer die continues to move at constant velocity.

11. The method according to claim 9, including the further steps of:

moving said inner die and said outer die in the same direction at equal velocity during an initial phase;

moving said inner die and said outer die in the same direction during a middle phase, but the inner die travels at higher velocity than the outer die; and keeping the inner die stationary in an final phase, while the outer die continues to move at constant velocity.

* * * * *